US006083029A

United States Patent [19]

Wu et al.

[11] Patent Number: 6,083,029

[45] Date of Patent: Jul. 4, 2000

[54] MULTI-ROW DOCKING CONNECTOR OF REDUCED HEIGHT

[75] Inventors: Kun-Tsan Wu; Chin-Yi Lai, both of Tu-Chen, Taiwan

[73] Assignee: Hon Hai Precision Ind. Co., Ltd., Taipei Hsien, Taiwan

[21] Appl. No.: 09/158,965

[22] Filed: Sep. 21, 1998

[30] Foreign Application Priority Data

Sep. 20, 1997 [TW] Taiwan ..... 86216162

[51] Int. Cl.[7] ..... H01R 13/625

[52] U.S. Cl. ..... 439/347; 439/342

[58] Field of Search ..... 439/347, 74, 680, 439/284, 287, 290, 291, 292, 293, 295, 289, 342, 343, 660, 345, 346, 108, 947, 670, 701, 712, 717, 724, 732, 67, 69, 607, 609

[56] References Cited

U.S. PATENT DOCUMENTS

| | | | |
|---|---|---|---|
| D. 404,710 | 1/1999 | Lai et al. | D13/147 |
| D. 404,711 | 1/1999 | Lai et al. | D13/147 |
| 3,070,789 | 12/1962 | Murphy | 439/291 |
| 4,880,392 | 11/1989 | Schieferly | 439/347 |
| 5,613,879 | 3/1997 | Fonteneau et al. | 439/607 |
| 5,915,982 | 6/1999 | Kashiyama et al. | 439/157 |
| 5,989,049 | 11/1999 | Walkup et al. | 439/342 |
| 6,004,152 | 12/1999 | Walkup et al. | 439/342 |
| 6,022,236 | 2/2000 | McHugh et al. | 439/342 |

*Primary Examiner*—Paula Bradley
*Assistant Examiner*—Ross Gushi

[57] ABSTRACT

An assembly of a plug and a receptacle connector having a reduced overall widthwise dimension. Each of the plug and receptacle connectors includes a base board, an enclosing board aligned with the base board, a number of electrical terminals retained between the base board and the enclosing board, and a cover board securely mounted to the base board. The cover board of the plug connector is slidingly engaged with the cover board of the receptacle connector. The cover board and the base board are both substantially flat and have a width which is significantly less than the respective length.

13 Claims, 11 Drawing Sheets

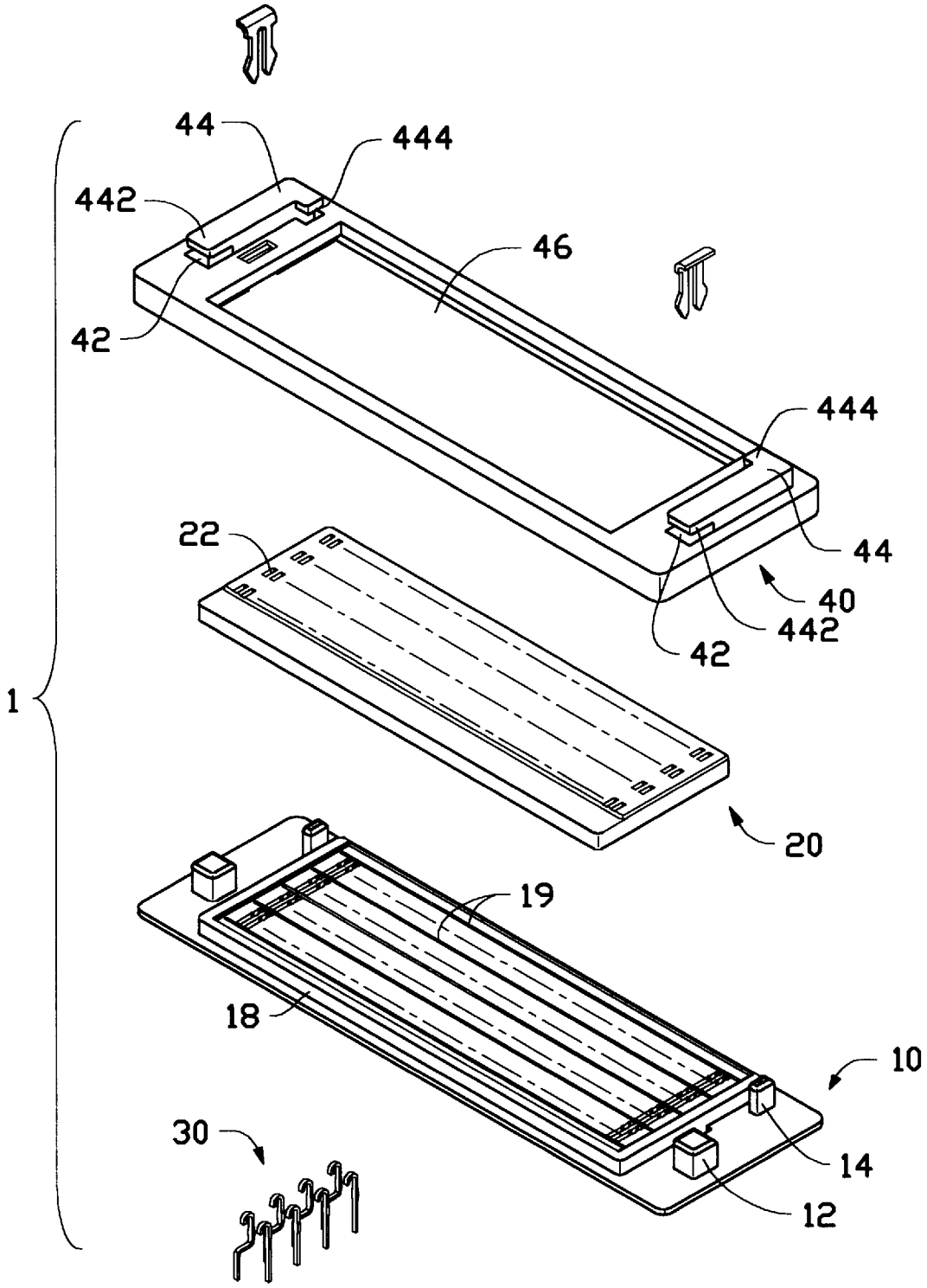
FIG.1
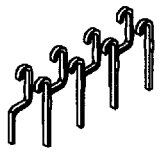

MULTI-ROW DOCKING CONNECTOR OF REDUCED HEIGHT

BACKGROUND OF THE INVENTION

The present invention relates to an electrical docking connector and in particular to an assembly of matable, multi-row docking connectors in which the connectors are mated to each other along a direction substantially parallel to their mating faces.

Connectors are continually designed toward compact size, superior signal integrity, and low profile. A typical docking connector can be seen in U.S. Pat. No. 5,219,294 issued to Marsh et al. on Jun. 15, 1993. The Marsh et al. patent discloses a receptacle connector and a mating plug connector. The receptacle connector comprises an insulating housing having a plurality of electrical terminals received therein and a front shield. The mating plug connector also comprises a housing receiving a plurality of electrical terminals and an outer shielding shell. The shell of the plug connector is brought to matingly engage with the shield of the receptacle connector along a direction perpendicular to mating faces of the plug and receptacle connectors. Threaded mounting holes are provided on the plug and receptacle connectors. In this design, since both the shell and the shield have a substantial width, a given widthwise dimension of the connectors will be needed.

In order to reduce a widthwise dimension of the connectors, the present invention provides plug and receptacle connectors which are mated together along a direction substantially parallel to their mating faces.

BRIEF SUMMARY OF THE INVENTION

The main object of the present invention is to provide an assembly of plug and receptacle connectors having a reduced width to save space.

In accordance with one aspect of the present invention, each of the plug and receptacle connectors comprises a base board, an enclosing board aligned with the base board, a plurality of electrical terminals each retained between the base board and the enclosing board, and a cover board securely mounted to the base board. The cover board of the plug connector is slidingly pluggable onto the cover board of the receptacle connector.

Preferably, the cover board of the plug connector comprises a pair of locking lugs and the cover board of the receptacle connector comprises a air of locking holes for receiving the corresponding pair of locking lugs.

Preferably, each electrical terminal has a pair of side protrusions, each base board has one or more rows of contact-receiving cavities with each contact-receiving cavity having a pair of first recesses, and each positioning board has one or more rows of contact-enclosing cavities corresponding in number to and aligned with the contact-receiving cavities. Each contact-enclosing cavity has a pair of second recesses which complement with the associated pair of first recesses of each contact-receiving cavity to matingly accommodate the pair of side protrusions of the electrical terminal.

Other objects, advantages and novel features of the invention will become more apparent from the following detailed description when taken in conjunction with the accompanying drawings.

BRIEF DESCRIPTION OF THE SEVERAL VIEWS OF THE DRAWING

FIG. 1 is an exploded perspective view of a plug connector in accordance with the present invention;

DETAILED DESCRIPTION OF THE INVENTION

Figure 2:
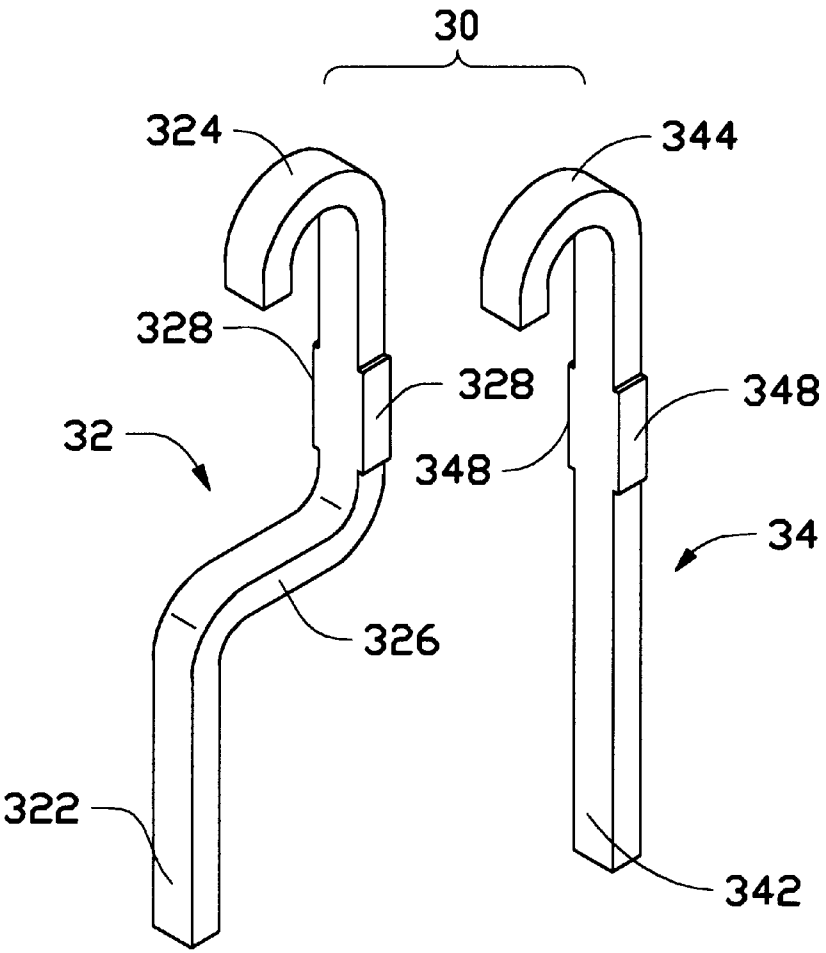
FIG. 2 is a perspective view of an electrical terminal used with the plug connector.

The present invention relates to an assembly of a plug connector and a receptacle connector. The plug connector will be described first in reference to FIGS. 1 through 6.

The plug connector, generally identified by reference numeral 1, consists of a base board 10, an enclosing board 20 aligned with the base board 10, a plurality of electrical terminals 30 to be retained between the base board 10 and the enclosing board 20, and a cover board 40 to be securely mounted to the base board 10. The base board 10, the enclosing board 20 and the cover board 40 all have a substantially flat, rectangular shape and, in particular, a general thickness thereof is significantly less than a general length thereof.

The base board 10 has a number of positioning studs 12 and 14 formed thereon. In the embodiment shown, a large stud 12 and a small stud 14 are provided on each end of the base board 10. The base board 10 further has a rectangular ridge 18 for accommodating the enclosing board 20. A number of positioning grooves 19 are defined in the board 10 within the ridge 18. The cover board 40 defines a pair of positioning openings 42 in opposite ends thereof. The studs 12 and 14 are so arranged and sized as to interference fit within the periphery of the corresponding positioning opening 42 when the cover board 40 is mounted to the base board 10. The cover board 40 also forms a pair of locking lugs 44 by a punching technique. The locking lug 44 is located above the positioning opening 42 and has a first overhanging extension 442 horizontally extending in a widthwise direction of the cover board 40 and a second overhanging extension 444 horizontally extending in a lengthwise direction of the cover board 40. The cover board 40 further defines an opening 46 in a central portion thereof for receiving the ridge 18 of the base board 10.

FIG. 2 shows the two types of electrical terminals which are alternately arranged in a row along the lengthwise direction of the base board 10. In the embodiment shown in FIG. 1 four rows of terminals are mounted in the base board 10. Each first terminal 32 consists of a tail 322, a head 324 and an intermediate portion 326. A pair of side protrusions 328 are formed between the head 324 and the intermediate portion 326. Similarly, each second terminal 34 has a tail 342, a head 344 and a pair of side protrusions 348 formed therebetween. The tail 322 of the terminal 32 and the tail 342 of the terminal 34 are staggered in a widthwise direction of the connector 1. Corresponding to the terminals 32, 34, the base board 10 defines four rows of contact-receiving cavities 16 (cf. FIG. 3). Each contact-receiving cavity 16 is further defined with a pair of recesses 162 and the positioning board 20 has four rows of contact-enclosing cavities 22 corresponding to and aligned with the contact-receiving cavities 16. Each contact-enclosing cavity 22 has a pair of recesses 222 (cf. FIG. 5) which complement the associated pair of recesses 162 of each contact-receiving cavity 16 to matingly accommodate the pair of side protrusions 328 (or 348) of the electrical terminal 32 (or 34).

Figure 3:
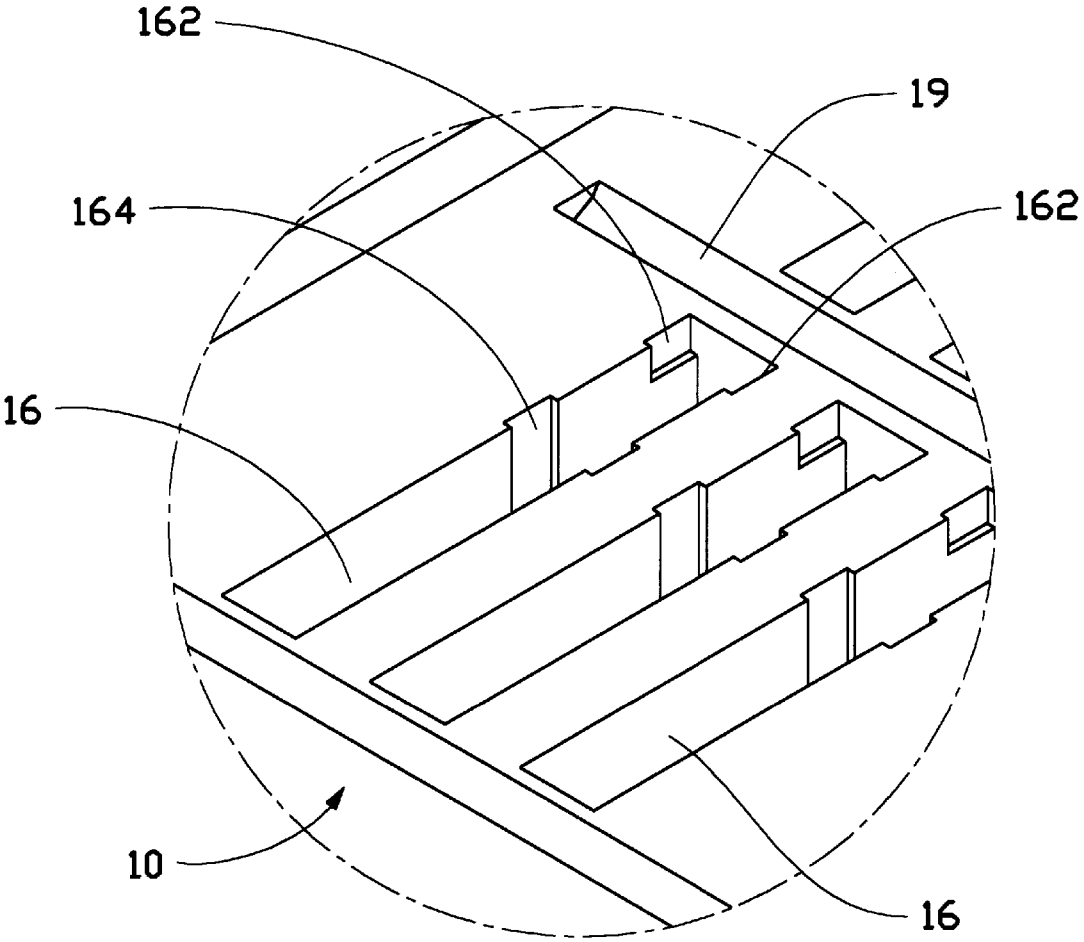
FIG. 3 is an enlarged view of a portion of a base board of the plug connector of FIG. 1.
Figure 4:
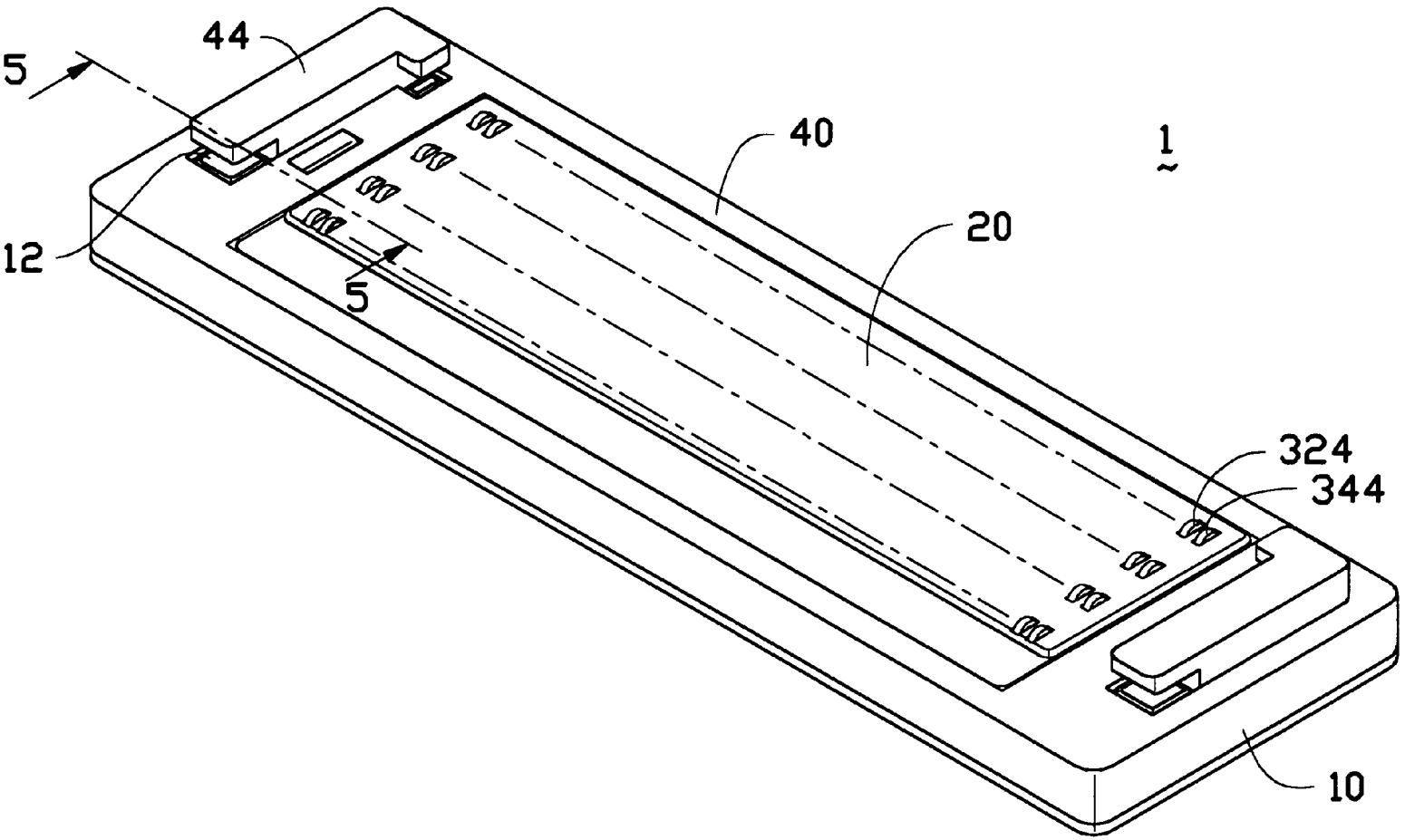
FIG. 4 is an assembled view of FIG. 1.
Figure 5:
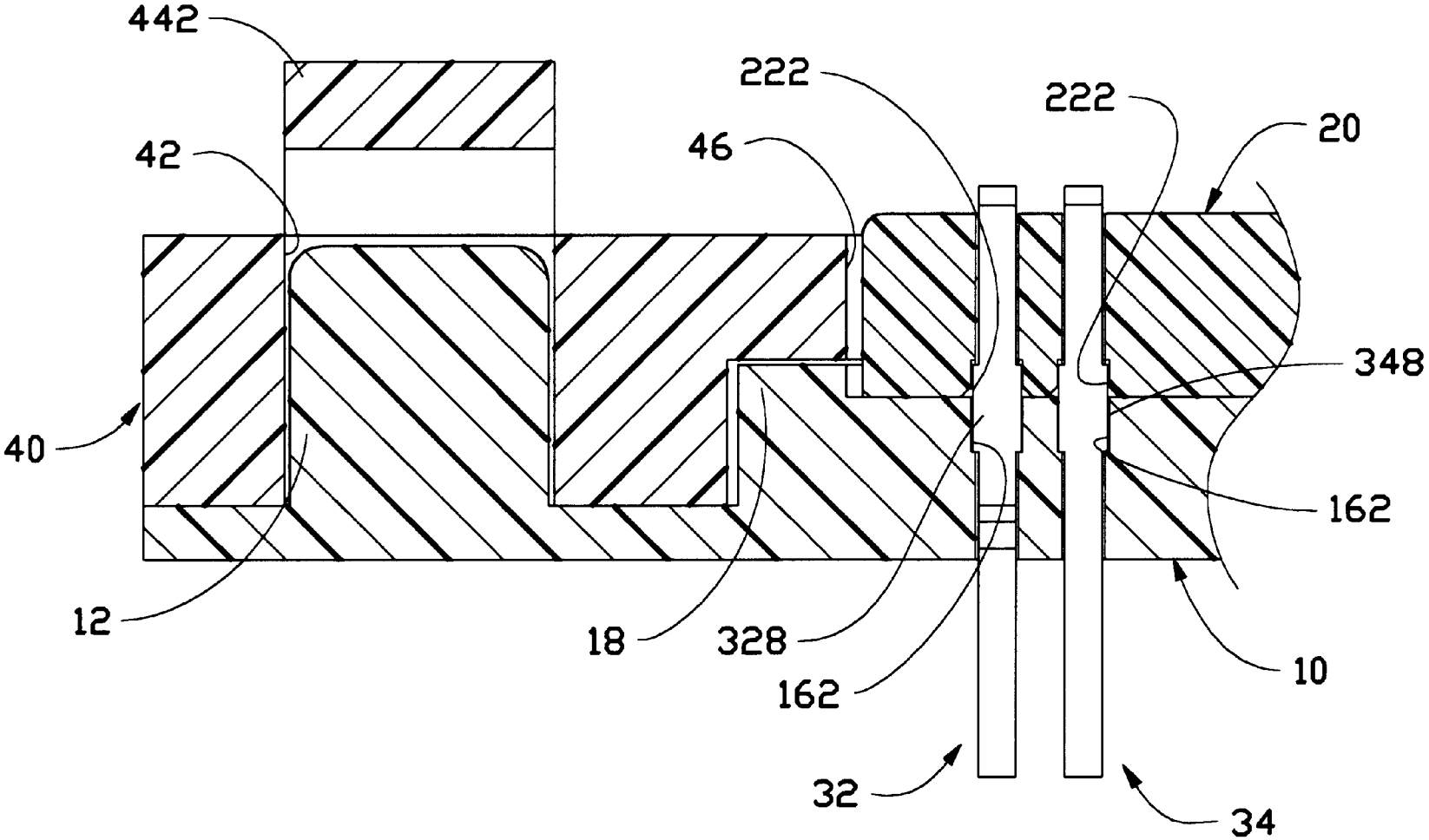
FIG. 5 is a cross-sectional view taken along line 5—5 of FIG. 4.
Figure 6:
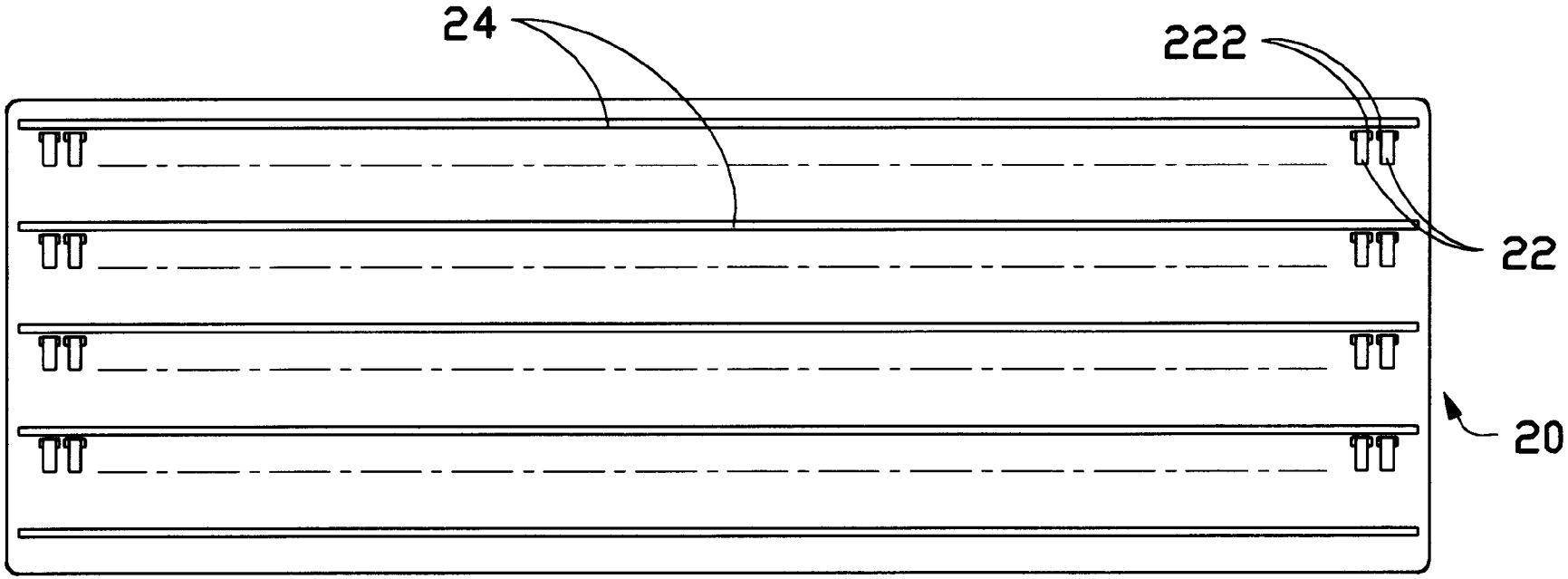
FIG. 6 is a bottom view of an enclosing board of the plug connector of FIG. 1.

Referring to FIG. 3, the contact-receiving cavities 16 of the base board 10 are further defined with a pair of flank recesses 164. The flank recesses 164 permit the terminal 32 to be inserted from a bottom of the base board 10, shifted along the widthwise direction, and then downwardly positioned within the base board 10. FIG. 4 shows the assembled plug connector 1 in which the heads 324 and 344 of the terminals 32 and 34 protrude beyond a top surface thereof. In FIG. 5, the recesses 162 and 222 of the cavities 16 and 22 cooperate with each other to contain the side protrusions 328 or 348 therein. The enclosing board 20 defines a number of positioning ribs 24 on a bottom surface thereof for engaging with the positioning grooves 19 of the base board 10.

The receptacle connector, generally identified by reference numeral 5, will be described with reference to FIGS. 7 through 9. It is noted that the receptacle connector 5 has a construction substantially similar to the plus connector 10 and, except for the distinctly different aspects, a detailed description thereof will be omitted.

Figure 7:
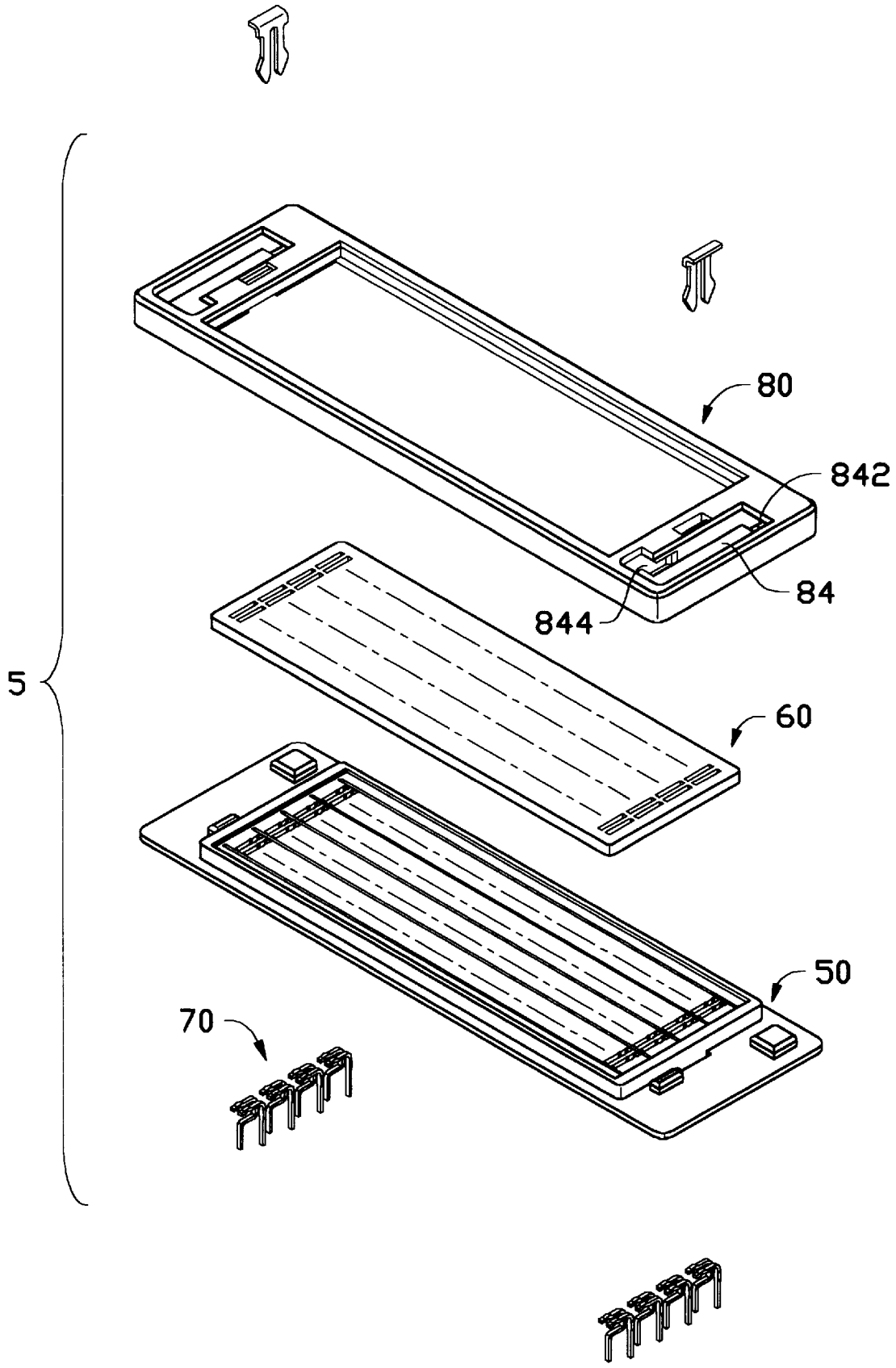
FIG. 7 is an exploded perspective view of a receptacle connector in accordance with the present invention.

As shown in FIG. 7, the receptacle connector 5 consists of a base board 50, an enclosing board 60, a plurality of electrical terminals 70 each to be retained between the base board 50 and the enclosing board 60, and a cover board 80. As in the case of the plug connector 1, the enclosing board 60 is aligned with the base board 50 and the cover board 80 is securely mounted to the base board 10. The base board 50, the enclosing board 60 and the cover board 80 are all substantially flat and rectangular and a general thickness of each board 50, 60, 80 is significantly less than a general length thereof. To cooperate with the locking lugs 44 of the cover board 40 of the plug connector 1, a pair of locking holes 84 of a complimentary shapes are defined in the cover board 80 of the receptacle connector 5. Other than the locking lugs 44, the cover board 80 is essentially identical to the cover board 40. In this situation, the positioning opening 42 will be identical to the locking hole 84 or, more exactly, a common board may be used for both the cover boards of the plug and receptacle connectors.

Moreover, the locking hole 84 is composed of a main section 842 defined along a widthwise direction of the cover board 80 for reception of the first overhanging extension 442 of the locking lug 44, and a side section 844 defined along a lengthwise direction of the cover board 80 for reception of the second overhanging extension 444 of the locking lug 44. With this construction, the cover board 40 of the plug connector 1 is slidably movable with respect to the cover board 80 of the receptacle connector 5 upon reception of the first and second overhanging extensions 442 and 444 of the locking lug 44 into the locking hole 84, thereby securing the cover board 40 of the plug connector 1 to the cover board 80 of the receptacle connector 5.

Figure 8:
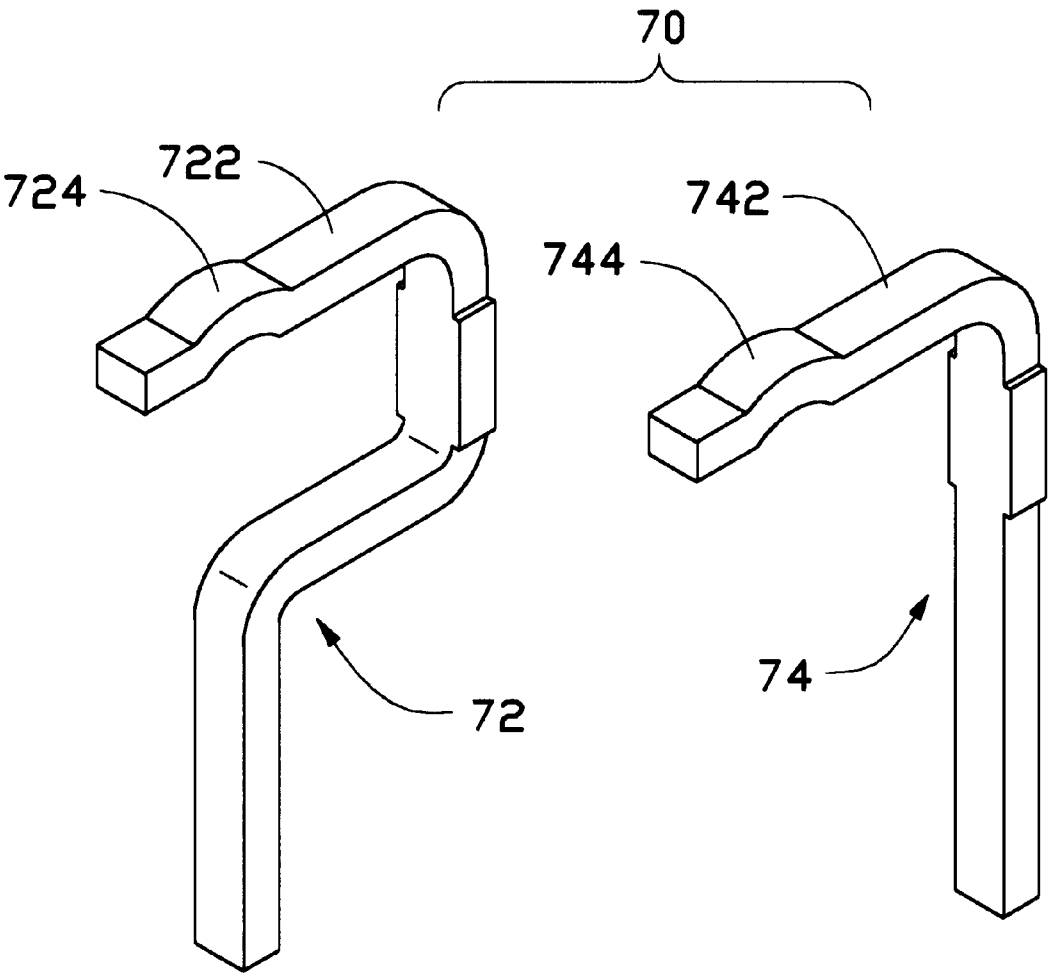
FIG. 8 is a perspective view of an electrical terminal used with the receptacle connector.
Figure 9:
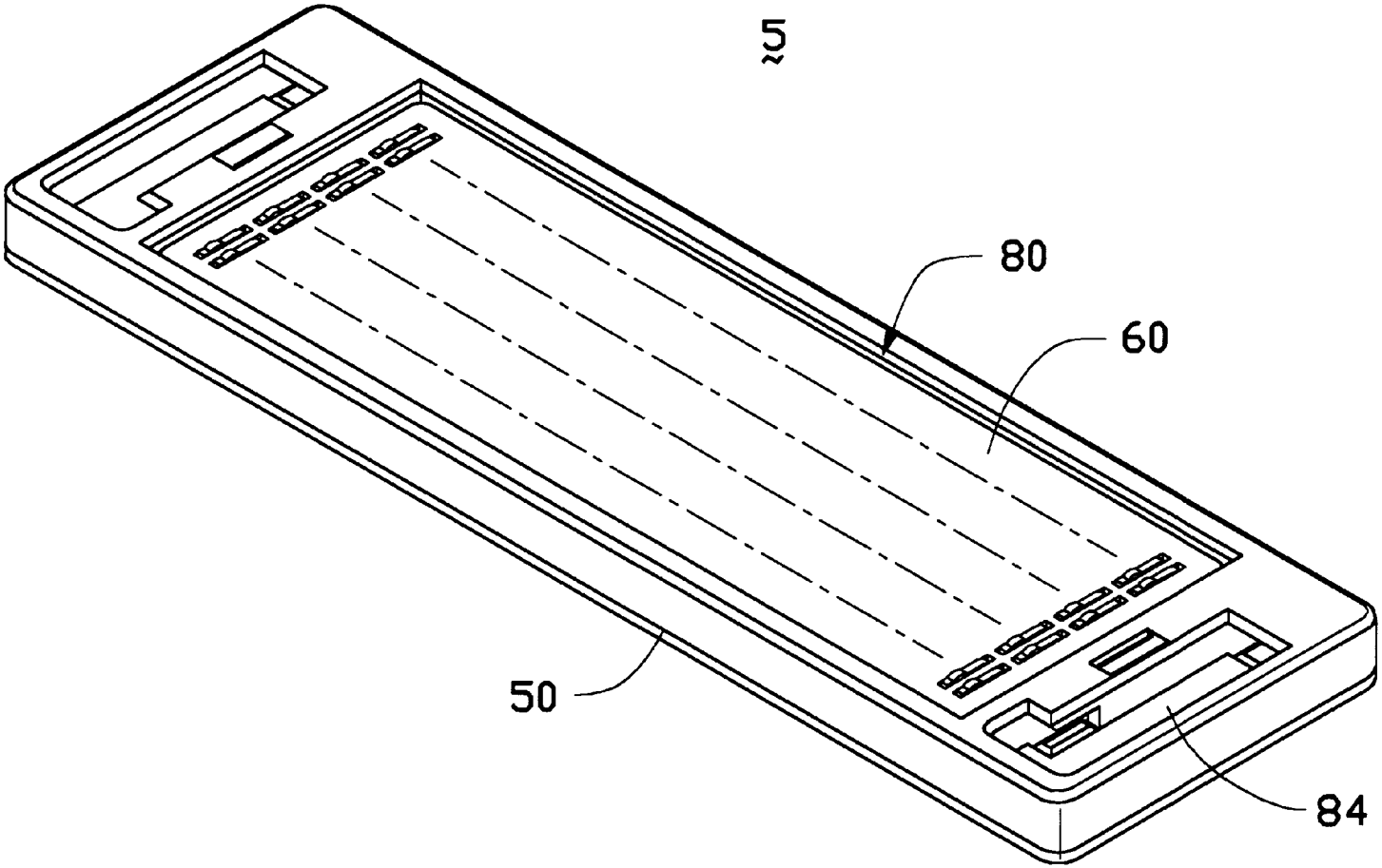
FIG. 9 is an assembled view of the receptacle connector shown in FIG. 7.
Figure 10:
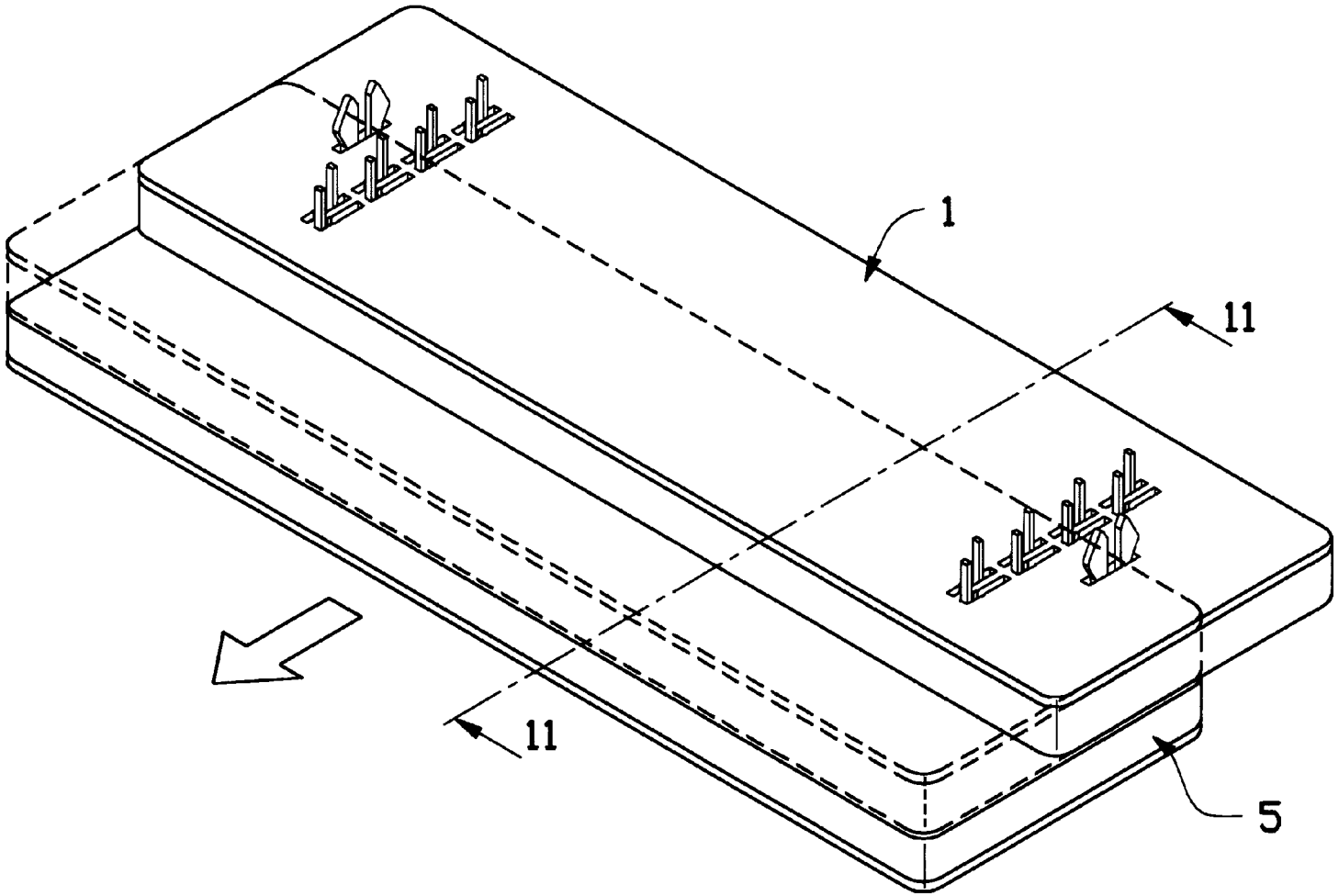
FIG. 10 shows the process of engaging the plug connector of FIG. 4 with the receptacle connector of FIG. 9.
Figure 11:
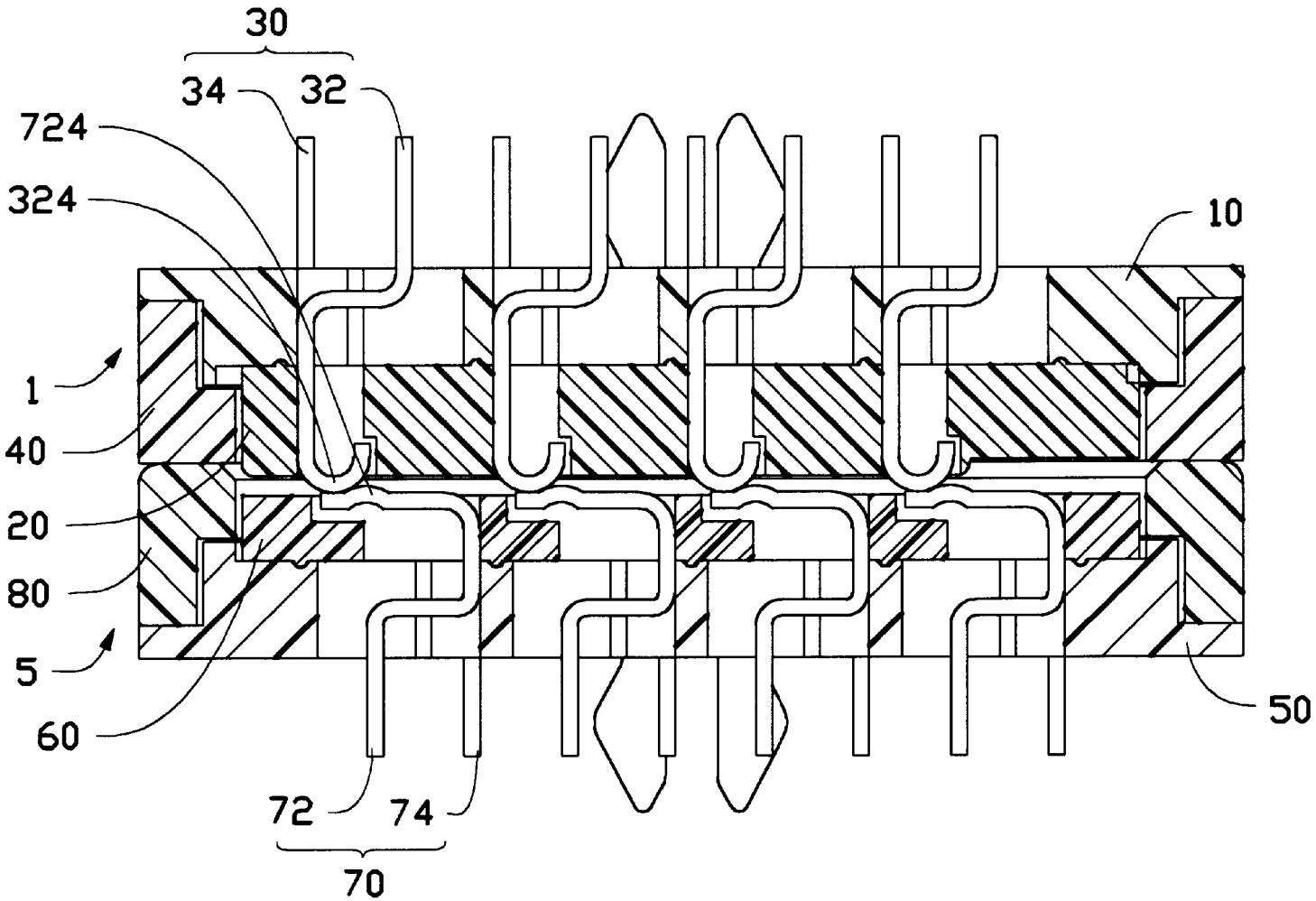
FIG. 11 is a cross-sectional view taken along line 11—11 of FIG. 10.

The set of terminals 70 of the receptacle connector 5, as shown in FIG. 8, is slightly different from the set of terminals 30 of the plug connector 1 in that the head 722 or 742 of the terminals 70 is cantilevered so that when the terminals 70 contact the terminals 30, the resiliency of the heads 722, 742 of the terminals 70 will provide a good contact surface. The relationship between the terminals 30, 70 is more clearly shown in FIG. 11. A bulged contact 724, 744 is suitably formed on the head 722, 742 of each terminal 70 to facilitate good contact between terminals 30, 70. FIG. 9 shows the assembled receptacle connector 5 wherein respective heads 722, 742 of each terminal 72, 74 protrude beyond a top surface thereof for electrical and mechanical mating with corresponding head 324, 344 of each terminal 30 of the plug connector 1. As shown in FIG. 10, when the plug connector 1 is to be connected to the receptacle connector 5, the plug connector 1 is inverted so that the locking lugs 44 are inserted into the locking holes 84. Then, the cover board 40 of the plug connector 1 may be slidingly plugged onto the cover board 80 of the receptacle connector 5. The assembled combination of plug and receptacle connectors 1 and 5 will have a reduced thickness compared to conventional designs.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

Additionally, one feature of the invention is to provide face-to-face confrontation engagement of the terminals between the plug connector and the receptacle connector, which changes the conventional engagement between terminals along a lengthwise direction to along a transverse direction. Under this situation, the terminal endures a relatively significant forces in the lengthwise direction, and this is the reason why the invention uses two boards, i.e., the base board and the enclosing board, to securely sandwich the side portion of the terminal in position. Oppositely, the traditional connector only endures a relative minor reaction force along the lengthwise direction, and it is okay to use one piece housing to retain the terminals with an interference fit arrangement.

What we claim is:

1. An assembly of a plug connector and a receptacle connector, each of the plug and receptacle connectors comprising:

a base board;

an enclosing board aligned with the base board;

a plurality of electrical terminals each retained between the base board and the enclosing board; and a cover board securely mounted to the base board;

the cover board of the plug connector being partially insertable into the cover board of the receptacle connector in a mating direction and being slidable relative to the cover board of the receptacle connector in a direction perpendicular to the mating direction to thereby couple the plug connector with the receptacle connector.

2. The claimed in claim 1, wherein:

each electrical terminal has a pair of side protrusions;

each base board has one or more rows of contact-receiving cavities with each contact-receiving cavity having a pair of first recesses; and each enclosing board has one or more rows of contact-enclosing cavities corresponding in number to and aligned with the contact-receiving cavities, each contact-enclosing cavity having a pair of second recesses which complement the associated pair of first recesses to matingly accommodate the pair of side protrusions of the electrical terminal.

3. The assembly as claimed in claim 1, wherein:

the cover board of each connector has a number of positioning openings; and the base board of each connector has a corresponding number of positioning studs for interference fitting with a periphery of each positioning opening.

4. The assembly as claimed in claim 1, wherein the cover board of each connector is substantially flat.

5. The assembly as claimed in claim 1, wherein the base board of each connector is substantially flat.

6. The assembly as claimed in claim 1, wherein:

the cover board of the plug connector comprises a pair of locking lugs; and the cover board of the receptacle connector comprises a pair of locking holes each engageable with a corresponding one of the pair of locking lugs.

7. The assembly as claimed in claim 6, wherein:

each locking lug is integrally formed with the cover board of the plug connector and has a first overhanging extension horizontally extending along a widthwise direction of the cover board of the plug connector and a second overhanging extension horizontally extending along a lengthwise direction of the cover board of the plug connector;

each locking hole has a main section defined along a widthwise direction of the cover board of the receptacle connector for reception of the first overhanging extension of the locking lug and a side section defined along a lengthwise direction of the cover board of the receptacle connector for reception of the second overhanging extension of the locking lug; and the cover board of the plug connector is slidably movable with respect to the cover board of the receptacle connector upon insertion of the first and second overhanging extensions of the locking lug into the locking hole, thereby securely locking the cover board of the plug connector to the cover board of the receptacle connector.

8. An assembly of a plug connector and a receptacle connector wherein said plug and said receptacle connectors mate with each other in a face to face confrontation with forces exerted by deformation of terminals of the plug and receptacle connectors tending to move the plug connector and the receptacle connector away from each other, at least one of said plug connector and said receptacle connector comprising:

a base board; and an enclosing board aligned with and attached to the base board;

the base board defining a plurality of first cavities having first recesses;

the enclosing board defining a plurality of second cavities having second recesses in alignment with the first cavities, respectively; wherein each of the terminals of said at least one connector includes a side portion restrainably received within the corresponding first recess and second recess so as to secure said terminal within the at least one connector even though a head of the terminal, which protrudes out of a top surface of the enclosing board of the at least one connector, generates a force toward the base board of the at least one connector due to deformation of said terminal.

9. An assembly of a first connector and a second connector wherein said first and said second connectors mate with each other in a face to face confrontation with forces exerted by deformation of terminals of the first and second connectors tending to push the first connector and the second connector away from each other, said assembly comprising:

the first connector including a first base board and a first cover board attached to said first base board;

the second connector including a second base board and a second cover board attached to said second base board;

one of said first base board and said first cover board of the first connector comprising at least one locking lug; and one of said second base board and said second cover board of the second connector comprising at least one locking hole adapted to be engageable with the at least one locking lug for mating of the first and second connectors; wherein the at least one locking lug is integrally formed with said one of said first base board and said first cover board and has a first overhanging extension horizontally extending along a widthwise direction of the first cover board, and the at least one locking hole is formed in the one of said second base board and said second cover board with a main section defined along a widthwise direction of the second cover board.

10. The assembly as claimed in claim 9, wherein said locking lug further includes a second overhanging extension horizontally extending along a lengthwise direction of the first cover board, and said locking hole further is formed with a side section defined along a lengthwise direction of the second cover board, for reception of the second overhanging extension of the locking lug.

11. An assembly of a plug connector and a receptacle connector, each of the plug and receptacle connector comprising:

a base board;

an enclosing board aligned with the base board;

a plurality of electrical terminals each retained between the base board and the enclosing board; and a cover board securely mounted to the base board; and the cover board of the plug connector being slidingly pluggable onto the cover board of the receptacle connector; wherein the cover board of the plug connector comprises a pair of locking lugs; and the cover board of the receptacle connector comprises a pair of locking holes each engageable with a corresponding one of the pair of locking lugs; and wherein each locking lug is integrally formed with the cover board of the plug connector and has a first overhanging extension horizontally extending along a widthwise direction of the cover board of the plug connector and a second overhanging extension horizontally extending along a lengthwise direction of the cover board of the plug connector;

each locking hole has a main section defined along a widthwise direction of the cover board of the receptacle connector for reception of the first overhanging extension of the locking lug and a side section defined along a lengthwise direction of the cover board of the receptacle connector for reception of the second overhanging extension of the locking lug; and the cover board of the plug connector is slidably movable with respect to the cover board of the receptacle connector upon insertion of the first and second overhanging extensions of the locking lug into the locking hole, thereby securely locking the cover board of the plug connector to the cover board of the receptacle connector.

12. An assembly of a plug connector and a receptacle connector, each of the plug and receptacle connector comprising:

a base board;

an enclosing board aligned with the base board;

a plurality of electrical terminals each retained between the base board and the enclosing board; and a cover board securely mounted to the base board; and the cover board of the plug connector being slidingly pluggable onto the cover board of the receptacle connector; wherein each electrical terminal has a pair of side protrusions;

each base board has one or more rows of contact-receiving cavities, each contact-receiving cavity having a pair of first recesses; and each enclosing board has one or more rows of contact-enclosing cavities corresponding in number to and aligned with the contact-receiving cavities, each contact-enclosing cavity having a pair of second recesses which complement the associated pair of first recesses to matingly accommodate the pair of side protrusions of the electrical terminal.

13. An assembly of a plug connector and a receptacle connector, each of the plug and receptacle connector comprising:

a base board;

an enclosing board aligned with the base board;

a plurality of electrical terminals each retained between the base board and the enclosing board; and a cover board securely mounted to the base board; and the cover board of the plug connector being slidingly pluggable onto the cover board of the receptacle connector; wherein the cover board of each connector has a number of positioning openings; and the base board of each connector has a corresponding number of positioning studs for interference fitting with a periphery of each positioning opening.

* * * * *